US005112217A

United States Patent [19]

Ripka et al.

[11] Patent Number: 5,112,217

[45] Date of Patent: May 12, 1992

[54] METHOD AND APPARATUS FOR CONTROLLING FUEL-TO-AIR RATIO OF THE COMBUSTIBLE GAS SUPPLY OF A RADIANT BURNER

[75] Inventors: Chester D. Ripka, E. Syracuse; Daniel R. Clark, Fayetteville, both of N.Y.

[73] Assignee: Carrier Corporation, Syracuse, N.Y.

[21] Appl. No.: 557,355

[22] Filed: Aug. 20, 1990

[51] Int. Cl.[5] ..... F23N 3/00

[52] U.S. Cl. ..... 431/12; 431/78; 431/79; 431/75

[58] Field of Search ..... 431/12, 24, 78, 79, 431/71, 326, 328; 126/91 AC, 91 Ç; 236/15 E

[56] References Cited

U.S. PATENT DOCUMENTS

| | | | |
|---|---|---|---|
| 4,043,742 | 8/1977 | Egan et al. | 431/12 |
| 4,435,149 | 3/1984 | Actheimer | 431/12 |
| 4,445,359 | 5/1984 | Smith | 431/12 X |
| 4,599,066 | 7/1986 | Granberg | 431/329 |
| 4,746,287 | 5/1988 | Lannutti | 431/328 |
| 4,830,601 | 5/1989 | Dahlander et al. | 431/12 |
| 4,878,837 | 11/1989 | Otto | 431/328 |
| 4,927,350 | 5/1990 | Zabielski | 431/12 |
| 4,934,926 | 6/1990 | Yamazaki et al. | 431/12 X |

FOREIGN PATENT DOCUMENTS

| | | | |
|---|---|---|---|
| 0106322 | 6/1983 | Japan | 431/12 |
| 0108327 | 6/1983 | Japan | 431/79 |
| 0096830 | 5/1985 | Japan | 431/79 |

*Primary Examiner*—Carl D. Price

[57] ABSTRACT

In a heating appliance employing a radiant burner, a method and apparatus for setting the ratio of gaseous fuel to air supplied to the burner to a desired value. With the gaseous fuel flow rate held constant, the air flow rate is controlled to maintain the fuel-to-air ratio at the desired value. The invention uses a sensor that measures the intensity of radiation emitted by the burner. A control device compares the measured intensity to a reference intensity and regulates the air flow rate such that the measured intensity is equal to the reference intensity. The burner emits radiation equal to the reference radiation intensity when it is burning a combustible gas supply containing the desired fuel-to-air ratio, so that by regulating the air flow rate to cause the burner to emit the reference radiant intensity, the fuel-to-air ratio will be at the desired value.

9 Claims, 1 Drawing Sheet

METHOD AND APPARATUS FOR CONTROLLING FUEL-TO-AIR RATIO OF THE COMBUSTIBLE GAS SUPPLY OF A RADIANT BURNER

BACKGROUND OF THE INVENTION

This invention relates to the control of radiant burners. Also known as surface combustion, radiant energy or infrared burners, radiant burners are used in various types of heating appliances. More particularly, the invention relates to a method and apparatus for setting and maintaining the proportion of fuel gas to air in the combustible gas mixture supplied to a radiant burner at an optimum value.

Under ideal conditions, a radiant burner would burn with highest thermal efficiency and lowest production of undesirable emissions when the combustible gas supplied to the burner is a stoichiometric mixture of fuel gas and air, i.e. when the amount of air supplied is exactly sufficient to completely oxidize the amount of fuel supplied. Should the ratio of fuel to air increase above the stoichiometric value, or the mixture becomes fuel rich, however, unburned fuel and carbon monoxide will be present in the combustion gases produced by the burner.

Under actual operating conditions, if a radiant burner were to be configured to operate exactly at the stoichiometric ratio, design or manufacturing defects, transient or chronic departures toward the fuel rich condition from the stoichiometric ratio either generally or locally on the burner surface can result in the production of undesirable and hazardous emissions from the burner. It is general design and engineering practice therefore to operate radiant burners with the fuel air mixture containing some amount of excess air, i.e. where the combustible gas is fuel lean or the fuel to air ratio is below the stoichiometric ratio. Operating in an excess air condition helps to assure that all fuel will be burned and no hazardous combustion products formed. The optimum amount of excess air necessary in a given burner installation depends on a number of factors such as the construction and geometry of the burner and its surroundings as well as the type and composition of the fuel to be burned. In general, the typical radiant burner will begin to exhibit undesirable combustion characteristics as excess air decreases to less than about five to ten percent. In such a burner installation, it is common to design for an excess in percentage in the range of 15–30 percent. Operation at excess air percentages greater than within that optimum range results in degradation of burner performance, loss of efficiency or blowout.

While it is possible to directly measure the flow ratio of the fuel gas and air supplies to a burner and to regulate one or both of the flows so as to produce a combustible gas mixture that is optimum, such a detection and control system would be complex and prohibitively expensive in many applications. The designs of some burner applications include pressure switches to detect air flow rate, but such switches are capable only of detecting gross departures from the optimum excess air value and not of regulating the excess air percentage. Still other designs employ sensors which detect the presence and concentration of constituents, such as oxygen, of the flue gases emanating from the burner. Those designs however are subject to sensor fouling and can be unreliable and inaccurate. What is needed therefore is an economical, accurate and dependable means to automatically ensure that a radiant burner is supplied with a combustible gas that contains the optimum amount of excess air.

SUMMARY OF THE INVENTION

Accordingly, the invention discloses a novel method and apparatus for automatically monitoring the performance of a radiant burner and controlling the ratio of fuel gas to air in the combustible gas supplied to the burner so that the gas mixture is maintained at or near the optimum value of excess air.

It is widely known that radiant burners, when in operation, emit radiation in the upper ultraviolet, visible and near infrared spectrum. The intensity of that radiation varies with the percentage of excess air in the combustible gas supply. The variation is nonlinear, with a peak occurring near the stoichiometric ratio. Since direct measurement of the proportion of fuel gas and air in the combustible gas supplied to burners in heating appliances used in common residential and commercial applications is impractical and prohibitively expensive, the present invention takes advantage of the relationship between burner radiant intensity and the fuel gas to air ratio by using the intensity as an indirect measure of the excess air in the combustible gas supplied to the burner.

In the method and apparatus taught by the invention, the intensity of radiation emitted by the burner when the combustible gas supplied to the burner contains the desired amount of excess air is experimentally determined by measuring the intensity when the burner is burning a combustible gas known to have the desired proportions of gaseous fuel and air. Then, in service, with the fuel gas supply flow rate held constant at a given value, the combustion air flow rate is adjusted to achieve and maintain the burner radiated intensity at a value equal to the experimentally determined intensity, thus achieving and maintaining the desired amount of excess air in the combustible gas supply to the burner.

The invention incorporates a sensor having an output that varies with the intensity received by the sensor, a control device and a variable speed air supply motor controller, motor and fan or blower. Because the sensitivity of commonly available sensors varies with age, the invention also incorporates a calibration radiation source for use in compensating for sensor sensitivity variation over time.

Upon each start-up of a heating appliance incorporating the invention, a start-up routine is performed that derives the control parameter necessary for the control device to correctly use the sensor output in controlling fan or blower speed. The control device may also be programmed to perform the calibration routine at periodic intervals, such as daily, during continuous operation. The apparatus of the invention may also serve as a safety device, supplementing or replacing safety related components now commonly found in heating appliances.

The invention is suitable for use with the constant supply fuel gas regulating valves widely used in heating appliances and a controllable variable combustion air supply to the appliance such as a variable speed induction or forced air fan or blower. The invention may also be used, with appropriate modifications, with fuel gas regulating valves of other than the constant supply type.

The novel features embodied in the invention are pointed out in the claims which form a part of this specification. The drawings and descriptive matter describe in detail the advantages and objects attained by the invention.

BRIEF DESCRIPTION OF THE DRAWINGS

The accompanying drawings form a part of the specification.

DESCRIPTION OF THE PREFERRED EMBODIMENT

Figure 1:
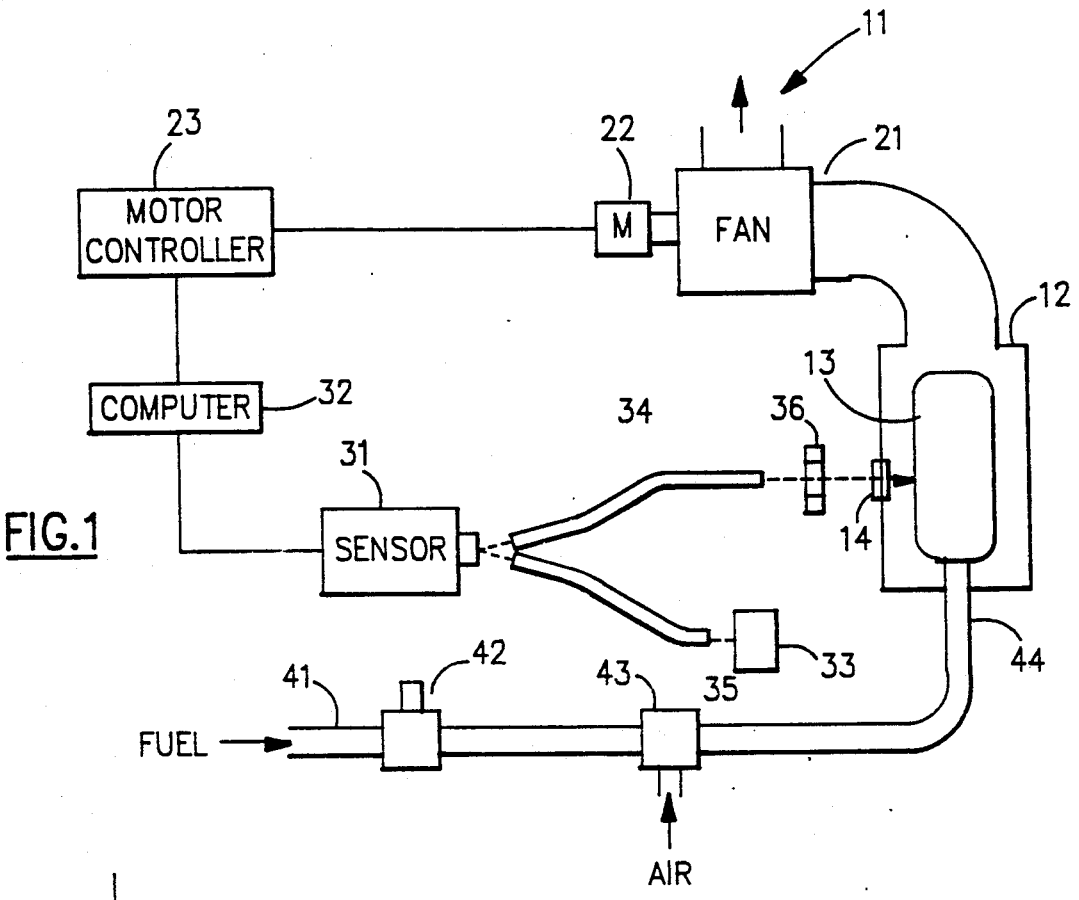
FIG. 1 is a schematic diagram of a heating appliance employing the apparatus taught by the invention.

FIG. 1 illustrates the components and interconnections of the apparatus taught by the invention. In that drawing is shown heating appliance 11, for example a furnace or a water heater, having combustion chamber 12 within which is mounted radiant burner 13. Fuel gas is supplied to the appliance via fuel line 41 and constant flow regulating air box 43 to form a combustible gas that then passes to burner 13 via combustible gas line 44. Combustible gas is drawn into and through burner 13 and flue gas containing the products of combustion formed by burner 13 is drawn from combustion chamber 12 by induction fan 21 driven by variable speed motor 22 having motor controller 23. Window 14 in the wall of combustion chamber 12 allows the surface of burner 13 to be viewed from outside combustion chamber 12. Fiber optic cable 34 transmits radiation emitted by burner 13 from window 14 to sensor 31, allowing sensor 31 to be mounted in a position out of direct line-of-sight of window 14 and reducing the possibility that dust or foreign material will interfere with the transmission of radiation from window 14 to sensor 31. Sensor 31 is responsive to radiation in the upper ultraviolet, visible or near infrared spectra and produces an output that varies with the intensity of the radiation emitted by burner 13. Window 14 and fiber optic cable 34 are constructed of materials that afford optimum transmissivity of radiation in the selected spectrum. The output of sensor 31 is directed to control device 32, having within it a microprocessor, that performs the calculations and control functions necessary to set and maintain excess air at the desired percentage. An output of control device 31 is a control signal to motor controller 23. Motor controller 23, in turn, controls the speed of motor 22 and hence induction fan 21. Because of regulating valve 42, the flow rate of fuel gas is constant. By varying the speed of induction fan 21, the total flow rate of combustible gas through burner 13 can be varied. If fuel gas flow rate remains constant, an increase in total flow rate results in an increase in the relative proportion of air in the combustible gas and hence the amount of excess air in the combustible gas can be controlled by controlling the speed of induction fan 21.

Fiber optic cable 35 transmits radiation from calibration radiation source 33 to sensor 31 and is made of the same or similar material as fiber optic cable 34. Source 33 is used for system calibration and emits radiation in the spectrum to which sensor 31 is responsive and is of a type that will be reliable and stable over an extended period, such as a light emitting diode. Fiber optic cables 34 and 35 are arranged with respect to sensor 31 such that sensor 31 may receive radiation passed by either cable. Optional shutter 36 may be included to block the transmission or radiation from burner 13 and allows for system calibration even when burner 13 is ignited.

Figure 2:
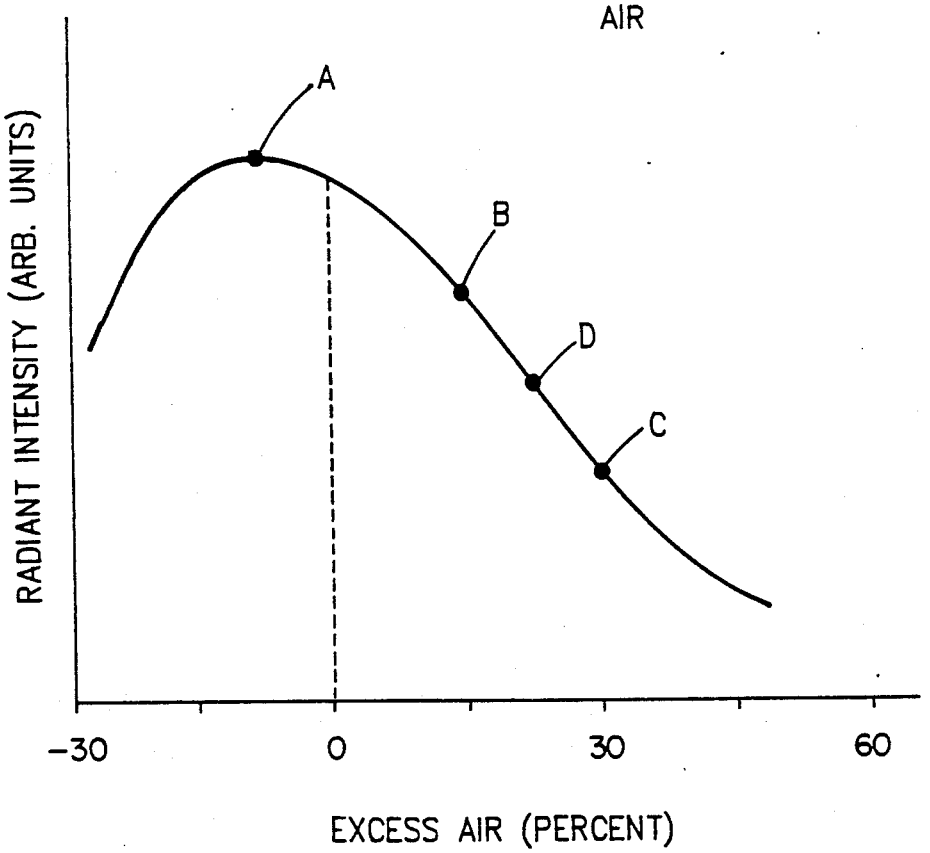
FIG. 2 is a graph of the intensity of radiation emitted by a radiant burner burning a combustible gas comprised of a mixture of methane and air as a function of the fuel gas to air ratio, expressed as a percentage of excess air, in the combustible gas supply.

The curve depicted in FIG. 2 shows the variation in intensity of the radiation emitted by a typical radiant burner as a function of the fuel gas to air ratio, expressed on the graph as a percentage of excess air, in the combustible gas supplied to the burner. The curve of FIG. 2 depicts infrared radiant intensity and is for a combustible gas comprising a mixture of methane and air. A curve of intensity variation for the same burner and fuel supply in the upper ultraviolet or visible spectra would be similar. As can be seen from FIG. 2, radiant intensity reaches a peak (at point A in the figure) near the stoichiometric ratio (where excess air percentage is 0). Note that between point B and point C, in the range of 15 to 30 percent excess air, the curve is nearly linear. Point D on the curve denotes the position on the curve where excess air percentage is optimum. Intensity versus excess air curves for burners burning other common gaseous fuels are somewhat different but exhibit similar intensity peaks and near-linearity in a section of the curve on the positive excess air side of the peak.

In the method of the invention, a reference radiation intensity must be established. The reference radiation intensity is the intensity of radiation, as sensed by the sensor to be used in the appliance as built, emitted by the radiant burner to be used in the appliance when the burner is burning a reference combustible gas known to have the desired percentage of gaseous fuel and combustion air. This percentage will generally be when the burner is operating at point D on the curve of FIG. 2, or when excess air is in the range of 15–30 percent. The known fuel-air percentage may be established in the reference combustible gas using standard laboratory procedures and equipment. Depending on demonstrated repeatability and confidence factors such as manufacturing tolerances and specific equipment configurations, establishment of a reference radiation intensity may be required for each pairing of a specific burner and sensor, for each batch of burners and/or sensors, or merely for each combination of burner and/or sensor designs.

The sensitivity of commonly available sensors can vary over time. Therefore, the output of a given sensor in response to the radiation emitted by a given burner can vary with sensor age even if the composition of the combustible gas burned by the burner remains unchanged. Hence, it is desirable to include a calibration capability in an appliance incorporating the invention. This is accomplished by the provision of a calibration radiation source. This source enables the control device to compensate for the variation in sensor sensitivity. The calibration radiation source can also be used to compensate for variation in the gain of any amplification applied to the sensor output. At the same time that the reference radiation intensity is established, together with the from the calibration source is also established and the two respective outputs compared, yielding a ratio or calibration factor that represents the difference, usually a multiple, between the sensor response to the calibration radiation source and the sensor response to the reference radiation intensity. This calibration factor will remain constant, given that both the reference radiation intensity and the intensity of the radiation from the calibration source remain constant, even if the absolute values of the sensor outputs should vary over the life of the sensor. When the calibration factor is determined from the experimentally determined intensities, it is entered into the program logic of the control device.

Referring again to FIG. 1, in operation after determination of the reference radiation intensity, proper installation and programming, a heating appliance 11 incorporating the method and apparatus of the present invention will function in the following manner.

Upon receiving a call for heat, either from a manual on-off switch or an external thermostatic switch (not shown), the appliance enters a start-up sequence. In the start-up sequence, a calibration subroutine is first performed in which control device 32 is energized and calibration radiation source 33 turned on. Control device 32 then measures the output of sensor 31 resulting from calibration source 33 and applies the calibration factor programmed into the logic of the device to calculate a setpoint sensor output. The setpoint sensor output is used by control device 32 as a control parameter, for if the output of sensor 31 equals the setpoint sensor output, then the intensity of the radiation emitted by the burner will be equal to the reference radiation intensity. After completion of the calibration subroutine, the start-up sequence is completed by turning off calibration radiation source 33, energizing induction fan 21, opening gas regulating valve 42 and igniting burner 13.

During normal operation after completion of the start-up sequence, control device 32 regulates the speed of fan motor 22, through controller 23, to maintain the flow of combustible gas into and through burner 13 such that the output from sensor 31 is equal to the setpoint sensor output. When the actual sensor output is equal to the setpoint value, the burner radiant intensity will be equal to the reference radiant intensity, and, as gaseous fuel flow rate is fixed, the combustible gas supply to burner 13 will be at the desired percentage of excess air.

With the incorporation of optional shutter 36 or other suitable means to temporarily block the path of radiation from window 14 to sensor 31, a calibration subroutine can be performed even when appliance 11 is operating. This may be desirable when the appliance is operated continuously for extended periods. In this case, control device 32 can be programmed to operate shutter 36, perform a setpoint sensor output computation and return to normal operation at periodic intervals, such as daily.

The apparatus of the present invention can provide several safety features for the heating appliance into which it is incorporated, supplementing or replacing other safety devices commonly found in present day heating appliances. The sensor and control device can detect the failure of a burner ignition device, e.g. a pilot light, hot surface igniter or spark ignition device, and prevent the gas regulating valve from opening if such a failure occurs. The sensor and control device can also verify burner ignition and initiate a shutdown if the burner flame should go out for any reason, supplanting a conventional flame sensor. Using standard control methods, the apparatus can rapidly respond to changed operating conditions such as blockage of the appliance flue, thus obviating the need for one or more pressure switches.

While a preferred embodiment of the present invention is shown and described, those skilled in the art will appreciate that variations, such as employing a forced rather than induced draft fan, may be produced that remain within the scope of the invention. The invention may also be used with an appliance having a gas regulating valve of other than the constant flow type, in which case suitable provisions must be made in the logic of the control device invention be limited only by the scope of the below claims.

What is claimed is:

1. In a heating appliance employing a surface combustion or radiant burner that burns a combustible gas comprised of a mixture of gaseous fuel and combustion air and that emits radiation while burning said combustible gas, having means for supplying said gaseous fuel to said radiant burner at one or more flow rates and having means for supplying said combustion air to said radiant burner at a variable flow rate, a method of setting the proportion of said gaseous fuel to said combustion air in said combustible gas to a desired proportion comprising the steps of:

determining a reference intensity, said reference intensity being the intensity of radiation emitted by said radiant burner when said radiant burner is burning a reference combustible gas, said reference combustible gas being a combustible gas having a proportion of gaseous fuel to combustion air that is equal to said desired proportion;

setting said gaseous fuel supply means at a given flow rate;

sensing the intensity of radiation emitted by said radiant burner while said radiant burner is burning said combustible gas; and controlling said combustion air supply means so as to reach and maintain a flow of combustion air that will produce a resultant combustible gas having such a proportion of gaseous fuel to combustion air that, when said radiant burner burns said resultant combustible gas, said radiant burner will emit radiation at an intensity equal to said reference intensity.

2. The method of claim 1 in which said radiation is in the upper ultraviolet, visible or near infrared spectra.

3. In a hearing appliance employing a surface combustion or radiant burner that burns a combustible gas comprised of a mixture of gaseous fuel and combustion air and that emits radiation while burning said combustible gas, having means for supplying said gaseous fuel to said radiant burner at one or more flow rates and having means for supplying said combustion air at a variable flow rate, an apparatus for setting the proportion of said gaseous fuel to said combustion air in said combustible gas to a desired proportion comprising:

means for setting said gaseous fuel supply means at a given flow rate;

means for sensing the intensity of said radiation;

means for comparing intensities sensed by said sensing means with a reference radiation intensity, said reference radiation intensity being the intensity of radiation emitted by said radiant burner when said radiant burner is burning a combustible gas having said desired proportion; and means for controlling said combustion air supply so as to produce a combustion air flow rate that will cause said radiant burner to emit radiation at an intensity equal to said reference radiation intensity.

4. The apparatus of claim 3 in which said radiation is in the upper ultraviolet, visible or near infrared spectra.

5. The apparatus of claim 4 in which said intensity sensing means comprises a sensor that responds to said radiation with an output that varies with the intensity of said radiation;

said comparison means and said control means comprise a control device having microprocessor means; and said combustion air supply means comprises an induction fan unit having a variable speed motor and controller.

6. The apparatus of claim 5 further comprising a fiber optics path between said radiant burner and said sensor.

7. The apparatus of claim 5 further comprising means for calibrating said sensor.

8. The apparatus of claim 7 in which said calibrating means comprises a calibration light source.

9. The apparatus of claim 8 further comprising a fiber optics path between said reference light source and said sensor.

* * * * *